US006779594B1

(12) United States Patent
Judge et al.

(10) Patent No.: US 6,779,594 B1
(45) Date of Patent: Aug. 24, 2004

(54) HEAT EXCHANGER ASSEMBLY WITH ENHANCED HEAT TRANSFER CHARACTERISTICS

(75) Inventors: John F. Judge, Stewartstown, PA (US); Mark R. Geesey, Felton, PA (US)

(73) Assignee: York International Corporation, York, PA (US)

( * ) Notice: Subject to any disclaimer, the term of this patent is extended or adjusted under 35 U.S.C. 154(b) by 307 days.

(21) Appl. No.: 09/407,116

(22) Filed: Sep. 27, 1999

(51) Int. Cl.[7] ..... F28F 13/16
(52) U.S. Cl. ..... 165/96; 165/109.1
(58) Field of Search ..... 165/96, 109.1

(56) References Cited

U.S. PATENT DOCUMENTS 2,605,377 A * 7/1952 Kaehni et al. ..... 165/109.1 X
3,370,644 A * 2/1968 Daily et al. ..... 165/95
3,448,791 A * 6/1969 Clark ..... 165/96
3,490,520 A * 1/1970 Delaney et al. ..... 165/47
4,401,148 A * 8/1983 Yabe et al. ..... 165/110 X
4,471,833 A * 9/1984 Yabe et al. ..... 165/109.1 X
4,480,684 A * 11/1984 Onishi et al. ..... 165/133 X
4,487,036 A 12/1984 Itoh et al.
4,651,806 A 3/1987 Allen et al. ..... 165/96
5,072,780 A 12/1991 Yabe
5,769,155 A 6/1998 Ohadi et al.

* cited by examiner

*Primary Examiner*—Leonard Leo
(74) *Attorney, Agent, or Firm*—Brian T. Sattizahn; McNees, Wallace & Nurick LLC

(57) ABSTRACT

A heat exchanger assembly for use in an HVAC system is provided. The heat exchanger assembly includes: a shell-type casing; a plurality of tubes located inside the shell-type casing, each of the tubes having an outer surface and an irregular inner surface; and a plurality of electrodes. Each electrode is located inside one of the corresponding tubes to create a space between the electrode and the inner surface of the tube. A first fluid is located in each space between the electrodes and the inner surfaces of the tubes. A second fluid is located in a space between the tubes and the shell-type casing to flow across the outer surfaces of the tubes. A voltage is applied on the electrodes in order to increase the rate of heat transfer between the first fluid and the second fluid. The invention also includes a method of exchanging heat between a heat transfer fluid and a refrigerant in a shell and tube heat exchanger.

18 Claims, 6 Drawing Sheets

HEAT EXCHANGER ASSEMBLY WITH ENHANCED HEAT TRANSFER CHARACTERISTICS

BACKGROUND OF THE INVENTION

1. Field of the Invention

This invention relates to heat exchanger evaporators and condensers, particularly those used in HVAC applications. In particular, the invention relates to a shell and tube type evaporator, where the refrigerant flows through the tubes and evaporates, while a heat transfer fluid flows through the shell and is cooled by the evaporating refrigerant. In a preferred embodiment, the evaporator is a component of a refrigeration system which can be used for cooling large quantities of water. This invention relates to an apparatus and method for increasing the heat transfer rate of these types of heat exchangers.

2. Description of the Related Art

Refrigeration systems of the type used to cool large quantities of water typically include a heat exchanger evaporator having separated passageways. One passageway carries refrigerant, and another carries the heat transfer fluid to be cooled, usually water. As the refrigerant travels through the evaporator, it absorbs heat from the heat transfer fluid and changes from a liquid to a vapor phase. After exiting the evaporator, the refrigerant proceeds to a compressor, then a condenser, then an expansion valve, and back to the evaporator, repeating the refrigeration cycle. The fluid to be cooled passes through the evaporator in a separate fluid channel and is cooled by the evaporation of the refrigerant. The fluid can then be routed to a cooling system for cooling the spaces to be conditioned, or it can be used for other refrigeration purposes.

It is desirable to optimize the heat transfer rate between fluids flowing through a heat exchanger, particularly large heat exchangers used in heating and air conditioning systems. A number of approaches have been proposed to improve the heat transfer characteristics of evaporators and condensers. One generally known approach is to create an electric field on a heat transfer surface in order to improve heat transfer. The use of an electric field to improve the heat transfer of convection heat transfer in a liquid is generally referred to as the electrohydrodynamic effect or EHD. Applications of this approach are disclosed in U.S. Pat. No. 4,651,806 to Allen et al., U.S. Pat. No. 5,072,780 to Yabe, and U.S. Pat. No. 5,769,155 to Ohadi et al.

While the general concept of EHD is known, the systems described in the prior art are cumbersome and difficult to install, and their efficiency is suspect.

Therefore, there is a need for a simple, small, and efficient apparatus and method for increasing the heat transfer rate of heat exchangers, particularly ones used to evaporate or condense refrigerants in HVAC systems.

SUMMARY OF THE INVENTION

The object of the present invention therefore is to provide improved heat exchanger methods and systems. Another object is to provide improved heat exchangers for HVAC applications that are made of inexpensive components, are economical to build, and are more compact than conventional heat exchangers.

The advantages and purposes of the invention will be set forth in part in the description which follows, and in part will be obvious from the description, or may be learned by practice of the invention. The advantages and purposes of the invention will be realized and attained by means of the elements and combinations particularly pointed out in the appended claims.

To attain the advantages and in accordance with the purposes of the invention, as embodied and broadly described herein, the invention includes a heat exchanger assembly for use in an HVAC system. The heat exchanger assembly includes: a shell-type casing; a plurality of tubes located inside the shell-type casing, each of the tubes having an outer surface and an irregular inner surface; and a plurality of electrodes. Each electrode is located inside one of the corresponding tubes to create a space between the electrode and the inner surface of the tube. A first fluid is located in each space between the electrodes and the inner surfaces of the tubes. A second fluid is located in a space between the tubes and the shell-type casing to flow across the outer surfaces of the tubes. A voltage is applied on the electrodes in order to increase the rate of heat transfer between the first fluid and the second fluid.

In another aspect, the invention includes an evaporator for transferring heat between a heat transfer fluid flowing over an outer surface of a tube and a refrigerant flowing through the tube. The evaporator includes: a tube including a first end, a second end, an inner surface with surface irregularities, and an outer surface; and an electrode located inside and spaced from the tube. The electrode includes an outer surface and has a voltage applied to produce an electric field. A refrigerant flows through the tube in the space between the electrode and the inner surface of the tube. A heat transfer fluid flows over the outer surface of the tube. The electric field produced by the applied voltage of the electrode presses the refrigerant against the surface irregularities on the inner surface of the tube in order to increase the heat transfer rate between the refrigerant and the heat transfer fluid.

In a further aspect of the invention, the invention includes a heat exchanger assembly. The heat exchanger assembly comprises: a tube including a first end, a second end, an inner surface and an outer surface; and an electrode located inside and spaced from the inner surface of the tube. The electrode includes an outer surface and has a voltage applied to produce an electric field. A first fluid flows in the space between the outer surface of the electrode and the inner surface of the tube, and a second fluid flows along the outer surface of the tube. One of the inner surface of the tube and the outer surface of the electrode includes surface irregularities, the effect of the electric field on the surface irregularities being an increase in the heat transfer rate between the first fluid and the second fluid.

In a yet further aspect of the invention, the invention includes a method of exchanging heat between a heat transfer fluid and a refrigerant in a shell and tube heat exchanger. The method includes the steps of: providing an electrode inside a hollow tube; flowing the refrigerant through the hollow tube in a space between the electrode and hollow tube, the refrigerant flowing along an inner surface of the hollow tube having surface irregularities; flowing the heat transfer fluid around an outer surface of the hollow tube; and applying a voltage to the electrode to create an electric field, the electric field pressing the refrigerant against the surface irregularities of the hollow tube to increase the heat transfer rate between the refrigerant and the heat transfer fluid.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

While the present invention has broader application regarding a heat exchanger assembly for transferring heat between fluids flowing in and fluids flowing over a tube, the invention was developed and has particular application as an evaporator assembly in an HVAC air cooled chiller system. It is most efficient to use a true counterflow unit, wherein the flow of water is in the opposite direction as the flow of the refrigerant. Conventional multiple pass evaporators, where one of the two fluids passes through tubing that switches back and forth, do not maximize the temperature difference between the refrigerant and the fluid in the shell. The counterflow configuration, on the other hand, maintains the greatest average temperature difference between refrigerant and fluid through the length of the heat exchanger, resulting in the greatest heat transfer, other variables being constant. In the preferred embodiment, the fluids flow in opposite directions, and each makes a single pass through the evaporator. It should be understood, however, that the present invention can also be used in a multipass evaporator.

In accordance with the present invention, a heat exchanger is provided with an increased heat rate due to the application of an electric field that causes a fluid to be pressed toward a heat transfer surface in a direction to increase the desired heat exchange. This effect is achieved by applying a voltage to an electrode fit within a heat exchanger tube and forming discontinuities on a surface of the tube or electrode. The heat exchanger is generally comprised of a shell-type casing, a plurality of tubes located inside the shell-type casing, and a plurality of electrodes. An electrode plate is provided for imparting the applied voltage on the electrodes.

Figure 1:
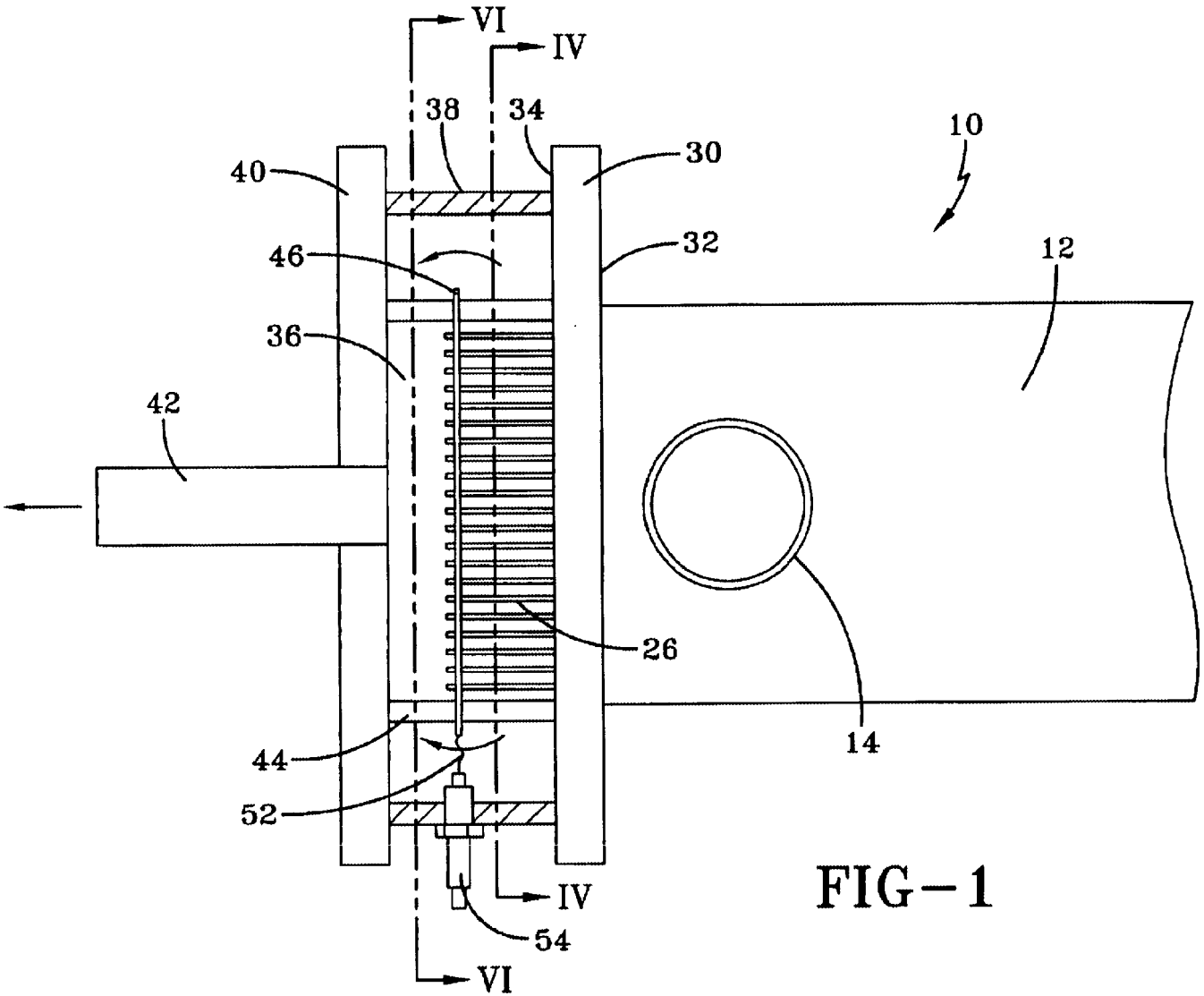
FIG. 1 is a partial side and partial cross-sectional view of a heat exchanger according to the present invention.
Figure 3:
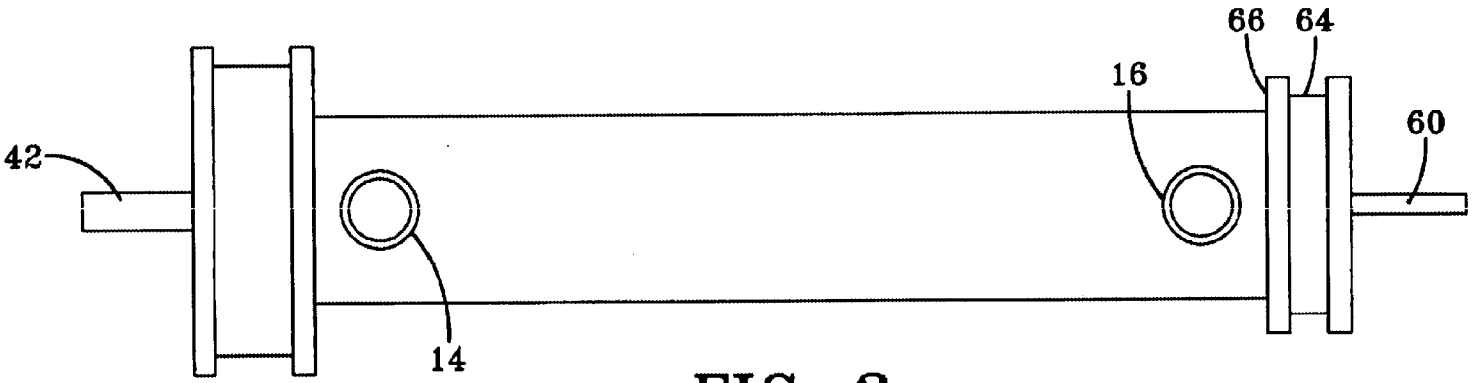
FIG. 3 is a side view of the heat exchanger of FIG. 2.
Figure 2:
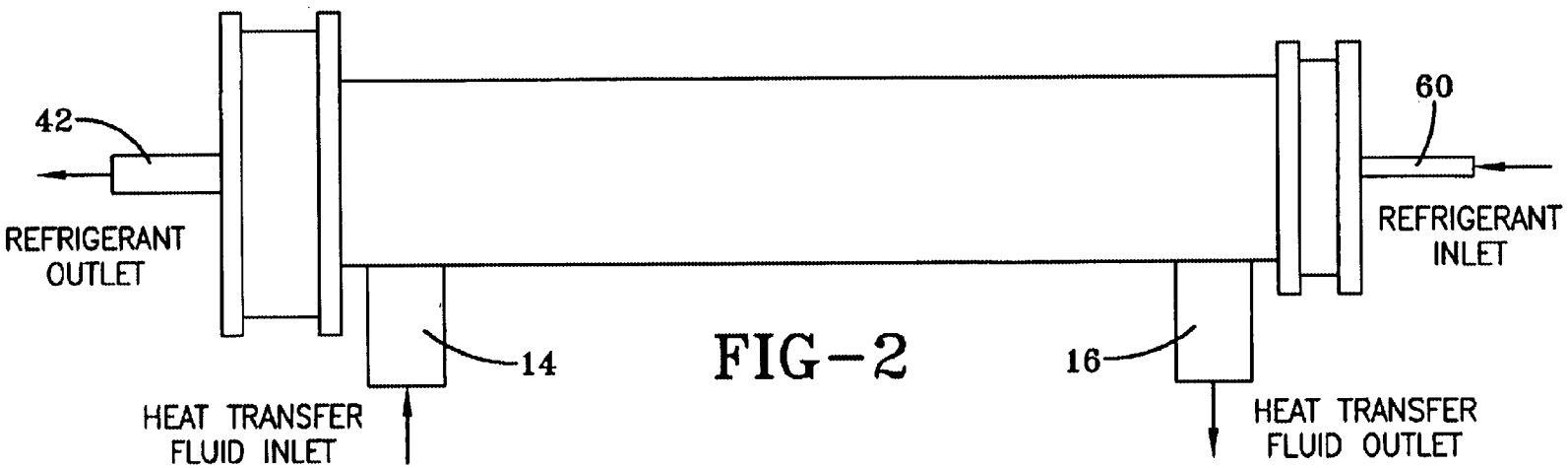
FIG. 2 is a top view of the heat exchanger of FIG. 1.

In accordance with the present invention, the heat exchanger includes a shell-type casing. In the embodiment shown in FIGS. 1–3, the heat exchanger is a shell and tube direct expansion evaporator. As embodied herein and shown in FIGS. 1–3, the heat exchanger 10 includes an elongated chamber or shell casing 12. The shell casing 12 is shown as being cylindrical, although a variety of other suitable sizes and shapes are also acceptable. The shell casing can be made out of any of a variety of conventional materials known in the field, for example, steel. The shell casing 12 includes a heat transfer fluid inlet 14 and heat transfer fluid outlet 16 as best shown in FIGS. 1–3. Water or other heat transfer fluid enters the shell casing at the inlet 14, travels through the shell 12, and then exits at the outlet 16 in a cooled state. As shown in FIGS. 1–3, the heat transfer fluid inlet 14 and heat transfer fluid outlet 16 are preferably located at the bottom portion of the shell casing. It should be understood that a variety of conventional heat exchanger shell casings are suitable for the present invention. The flow of the respective first and second fluids in the heat exchanger will be described in greater detail below.

The shell casing of the present invention is made of electrically conductive materials. Therefore, the shell casing is electrically grounded to prevent injury to operators and damage to the overall system.

Figure 4:
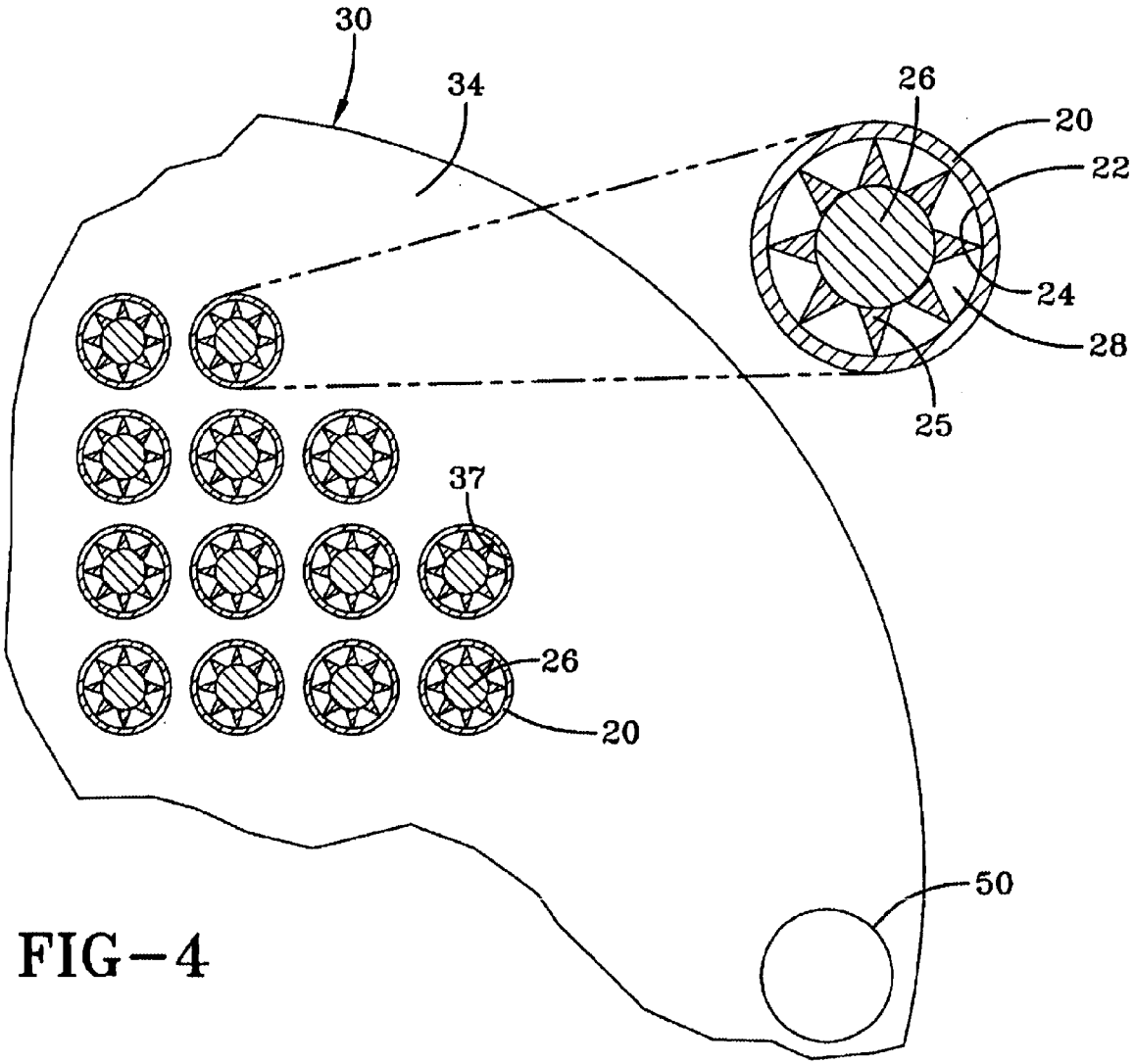
FIG. 4 is a partial cross-sectional view of a tube head of the heat exchanger along line IV—IV of FIG. 1.

In accordance with the present invention, the heat exchanger includes a plurality of tubes located inside the shell-type casing. As embodied herein and shown in FIGS. 4–5, a plurality of hollow tubes 20 are provided in the heat exchanger. The hollow tubes 20 extend from one end of the shell casing to the other. The tubes are bundled together in a parallel fashion, normally in the shape of a grid, as shown for example in FIG. 4. The number of tubes and the arrangement varies depending on the requirements of the specific application. The tubes are made out of conductive materials. The typical conductive material which is used is copper, although steel and any other suitable conductive material is also acceptable. The tubes have an outer surface 22 and an inner surface 24.

A first fluid comprising a refrigerant flows in a first axial direction across the inner surface 24 of the tubes and a second fluid flows in a second axial direction across the outer surface 22 of the tubes. The refrigerant enters the shell casing through refrigerant inlet 60, passing through a refrigerant baffle 64 and then past the refrigerant tube head 66, as shown in FIGS. 2 and 3. The refrigerant then enters the tubes in the shell casing. In the tubes, the refrigerant absorbs heat from the water or other heat transfer fluid and evaporates in whole or part.

In HVAC applications, the first fluid in an evaporator is a refrigerant. A variety of different types of refrigerants can be used with the present invention. Examples of refrigerants suitable for the present invention include, but are not limited to, R-22, R-134A, and R-407C. The selection of the type of refrigerant can have an affect on other factors such as pressure drop in the tubes, and the required diameter of the tubes. The tubes provide the heat transfer between the refrigerant and heat transfer fluid. Additional details on the specific surfaces of the tubes and the method of enhancing the heat rate across the tube surfaces are described further below.

In accordance with the present invention, the heat exchanger includes a plurality of electrodes. An electrode is located inside each of the corresponding tubes, and the electrode and tube combine to create an annular space between the electrode and the inner surface of the tube. As embodied herein and shown in FIGS. 1, and 4–7, a plurality of electrodes 26 are provided. The electrodes 26 are preferably in the shape of a longitudinal rod, although other shapes can be envisioned. Preferably, both the tube and the electrode have the same geometric shape, and most preferably both are circular in cross section.

The outside diameter of each electrode 26 is sized to be spaced from the inner surface 24 of its respective tube 20 when the electrode is positioned within the tube. It is desirable to have the diameter of the electrode as large as possible without causing excessive pressure drops. The space 28 between the outer surface of the electrode 26 and the inner surface 24 of the tube 20 contains the refrigerant that flows toward the refrigerant exit port 42.

The electrodes can be made out of any of the conventional materials typically used for electrodes. The material can be virtually any type of conductive metal. Typical electrodes are made of copper or steel, although any other suitable material is also acceptable. The end of each electrode 26 extends beyond the first end of each tube 20 as will be described below.

Figure 7:
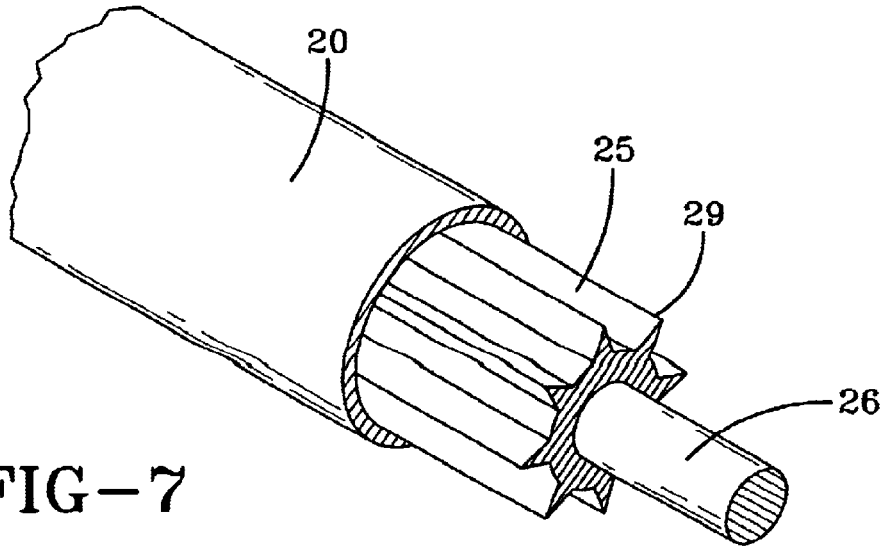
FIG. 7 is a perspective view of the electrode, tube, and an insulator.

In accordance with the present invention, an electrode insulator is provided between each electrode and the inner surface of the tube. As embodied herein and shown in FIGS. 4 and 7, the electrode insulator 25 prevents the electrode 26 from making contact with the inner surface 24 of tube 20. The electrode insulators are shaped to allow sufficient space for the fluid to flow between the tube and the electrode. Preferably, the insulator holds the electrode so that it is axially aligned with the tube with a uniform spacing between the outer surface of the electrode and the inner surface of the tube. In one embodiment, the electrode insulator has longitudinal ridges 29 as shown in FIG. 7. The electrode insulator can be of a variety of other sizes and shapes.

Figure 5:
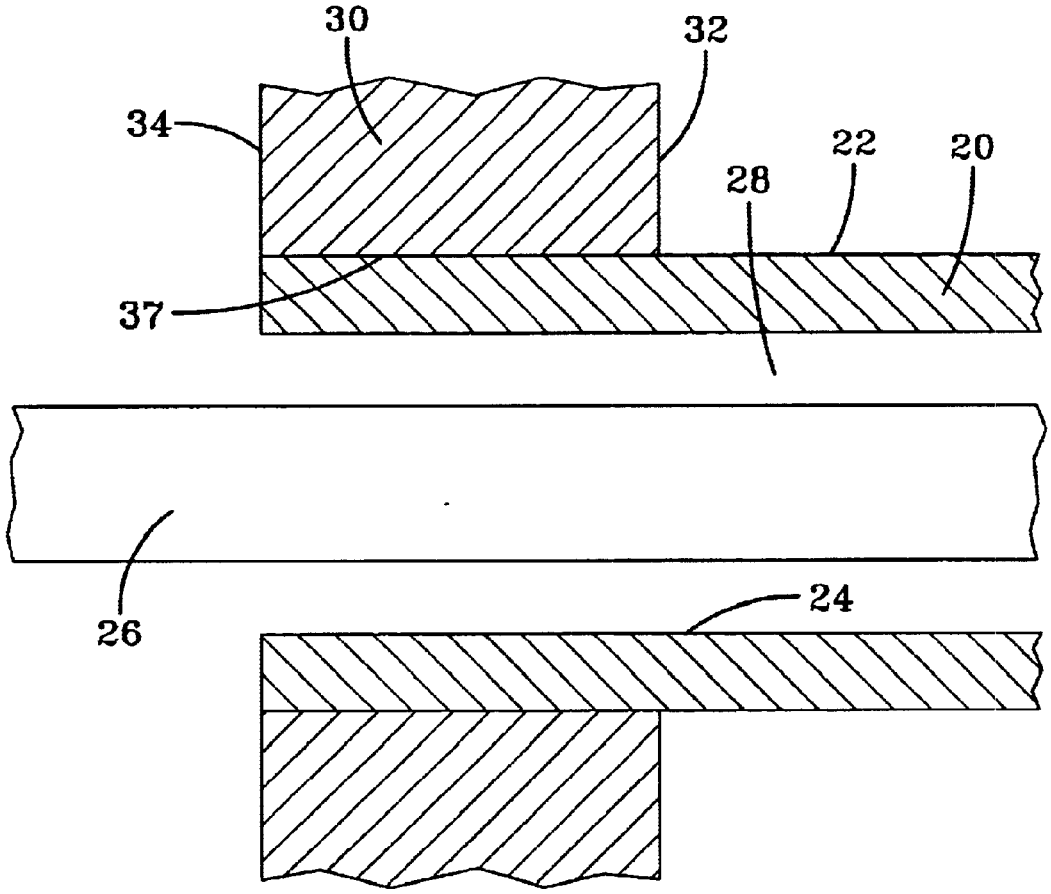
FIG. 5 is a partial cross-sectional view of an electrode positioned inside a tube in the heat exchanger of FIG. 1.

In accordance with the present invention, the heat exchanger also includes a tube head, refrigerant exit baffle, and cover plate. As embodied herein and shown in FIGS. 1–3, and 5–6, a tube head 30 is provided at the end of the shell casing 12. The tube head 30 is preferably in the shape of a flat disc with a first surface 32 and a second surface 34. The first surface 32 abuts against an end of the shell casing in a seated relationship. The second surface 34 abuts a refrigerant baffle 38 and support spacers 44 as will be described below. Tube head 30 includes tube holes 37 for accommodating the ends of the tubes 20. As shown in FIG. 5, the ends of the tubes 20 are flush with the second surface 34 of the tube head, with the electrode 26 projecting beyond the second surface 34 of the tube head into the refrigerant exit region 36. The tubes 20 are attached to the tube head by any of a variety of conventional methods.

As shown in FIG. 1, a refrigerant exit region 36 is defined by tube head 30, refrigerant baffle 38, and cover plate 40. In the embodiment shown in FIG. 1, the refrigerant baffle 38 is a cylindrical tube with a diameter slightly less than the diameter of tube head 30 and cover plate 40. The cover plate 40 is preferably in the shape of flat disc similar to the tube head 30. The refrigerant baffle 38 extends from the tube head 30 to the cover plate 40. These structures combine to define the volume of the refrigerant exit region 36. These three structures are combined in a sealed relationship. The refrigerant baffle, cover plate, and tube head can be made out of a variety of conventional materials typically used for these parts, such as carbon steel. Cover plate 40 includes a refrigerant exit port 42 in the shape of a hollow cylinder, as best shown in FIG. 1. The refrigerant in the refrigerant exit region 36 exits the heat exchanger 10 through refrigerant exit port 42.

In accordance with the present invention, the heat exchanger also includes electrically insulating spacers in the refrigerant exit region. As embodied herein and shown in FIGS. 1 and 6, electrically insulating support spacers 44 are provided in the refrigerant exit region 36. The spacers 44 extend from the tube head 30 to the cover plate 40. In the embodiment shown in FIGS. 1 and 5, there are four spacers 44 in the shape of longitudinal rods. In a preferred embodiment, the spacers are made of electrically insulating materials such as teflon or ceramics. However, any other suitable insulator is also acceptable. The spacers are used to support an electrode plate in the refrigerant exit region, as will be described below.

Figure 6:
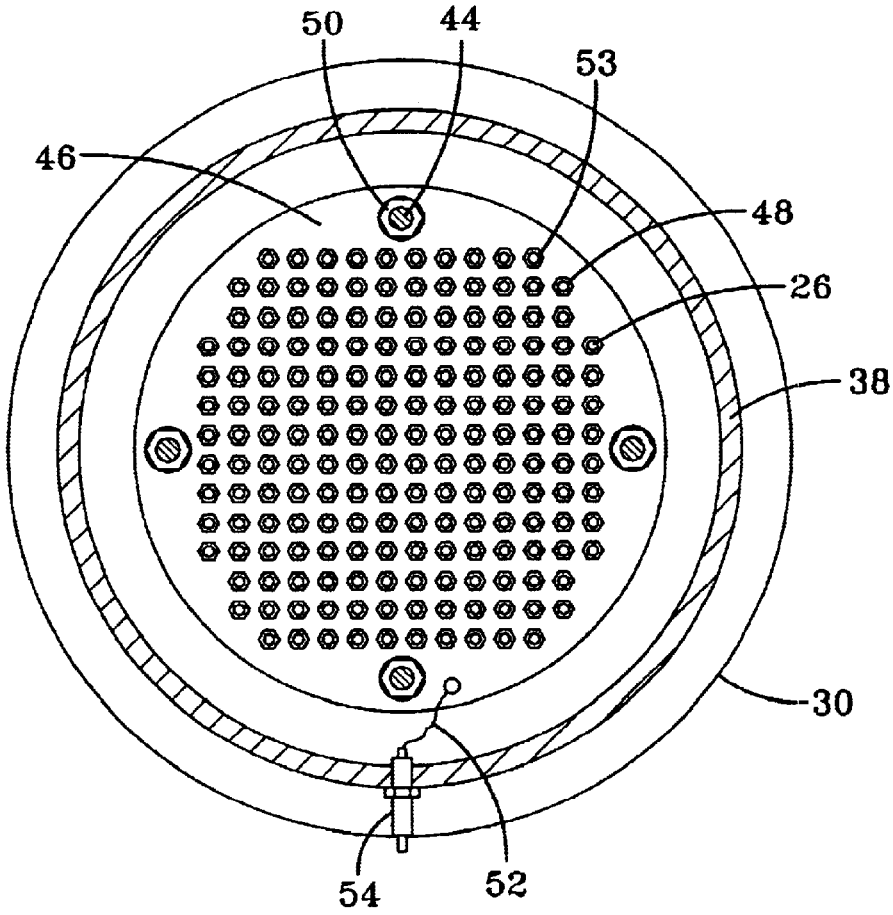
FIG. 6 is a partial cross-sectional view along line VI—VI of FIG. 1.

In accordance with the present invention, the heat exchanger also includes an electrode plate for imparting voltage on the electrodes. As embodied herein and shown in FIGS. 1 and 6, an electrode plate 46 is provided for imparting a voltage on the electrodes 26. The electrode plate 46 functions to provide a substantially uniform voltage to each of the electrodes 26. The electrode plate 46 is attached to the end of each of the electrodes. The electrodes are axially slid or screwed into holes 48 in the thin flat electrode plate 46. As shown in FIGS. 1 and 6, the electrode plate is supported on the support spacers 44 via holes 50. The support spacers 44 prevent the voltage from being imparted on the heat exchanger due to the insulating material of the spacers.

The electrodes can be attached to the electrode plate in a variety of ways. One preferred method is to provide threads on the ends of the electrodes so that the electrode plate can be bolted onto the electrodes. The threads are provided on only a limited end portion of the electrodes. As shown in FIG. 6, nuts 53 can be threaded onto the ends of the threaded electrodes to secure electrode plate 46 in place. In this method, the electrode plate will be squeezed between the nut and a collar on the electrode. Alternately, a collar is not needed if the portion of the electrode where the threads end has a greater diameter than the inner diameter of the threads. In another alternate method, the electrode plate could be provided with internal threaded holes for receiving the threaded electrodes. In this method, the electrodes would be directly screwed into the electrode plate, thereby dispensing of the need for nuts on the end of each of the electrodes if desired. All of the above methods allows for a relatively simple assembly and disassembly of the electrode plate from the electrodes. A variety of other suitable attachment methods can also be envisaged, as long as they provide for good mechanical and electrical connections.

The ends of the electrodes 26 opposite the ends attached to the electrode plate 46 do not extend into the inlet baffle region 64. The electrodes extend longitudinally in the tubes 20 until they reach the inlet tube head 66. The electrodes are supported throughout the tubes 20 by the electrically insulating electrode spacers 25. The spacers 25 are of approximately the same length as the tubes 20. The spacers 25 maintain the electrodes 26 in a substantially coaxial relationship with the tubes 20.

The voltage is provided to the electrode plate from an electrical source. An electrical connection can include a single wire 52 from an electrical source along with an electrical connector 54 to attach to the electrical source. In the embodiment shown in FIGS. 1 and 6, the electrical connector 54 passes through the wall of the refrigerant baffle 38 while maintaining a seal in the baffle. The electrical connector 54 shown in FIG. 1 is a ceramic insulator in the shape of a spark plug, but with no gap for a spark. The electrodes are maintained at high voltages, preferably between 2 and 50 kV, therefore a high voltage power source is required. A variety of direct current high voltage power sources are suitable for the present invention. For example, a power source similar to that used in a television, or for lab instrumentation can be adapted for use with the present invention. It is desirable to minimize the amount of money expended on supplying power to electrodes. Therefore, it is desirable to have a system where a minimal amount of voltage will result in greatly enhanced heat transfer.

For any given application, the increase of the voltage through the electrodes significantly increases the heat transfer rate of the tubes, up until a point where the increased heat transfer becomes minimum or is so small as to not equal the cost for increased voltage. The best voltage for a given application can be determined through empirical testing. Generally, the voltage can be increased to a point where it is practically unfeasible to measure any increase in heat transfer. At this point the heat transfer rate is nearly infinite. One aspect of the present invention is to apply a sufficient voltage to achieve close to maximum potential heat transfer, while minimizing energy costs.

The provision of an electrode inside a tube enhances heat rate between a refrigerant flowing through the inside of a tube and a second fluid flowing along the outside of the tube. When the tube and shell heat exchanger is used as an evaporator, the inner surface 24 of each tube 20 is provided with surface irregularities, while the outer surface of each electrode 26 is smooth. The provision of surface irregularities on the inner surface of the tubes increases the surface area of the inner surface in order to increase the heat transfer which occurs across the surface. An electrode is provided to produce an electric field on the inner surface of each tube when a voltage is applied to the electrode. The electric field is intensified at the surface irregularities, causing the refrigerant to be pressed against the inner surface regularities of the tube, thereby enhancing the heat transfer rate significantly.

Figure 8:
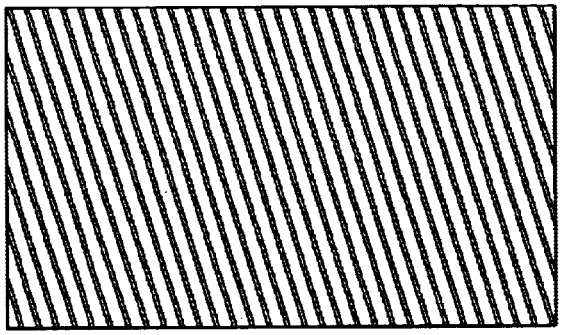
FIGS. 8–9 show exemplary surface irregularities for the inner surface of the tubes or the outer surface of the electrode.
Figure 9:
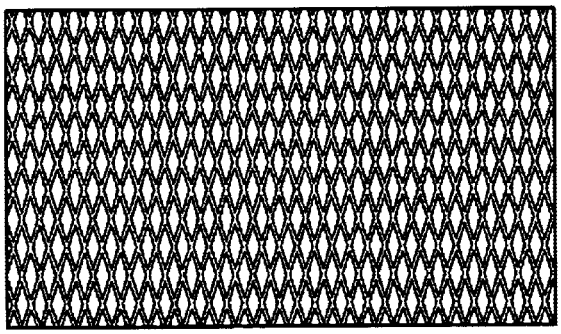
Figure 10:
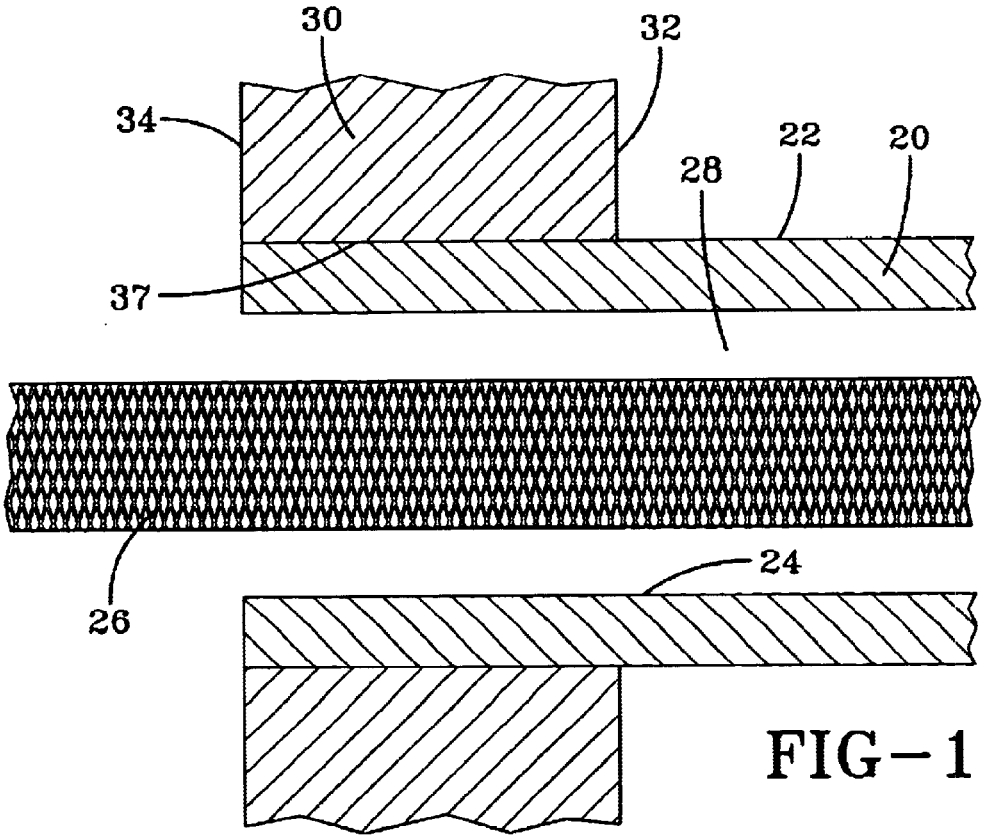
FIG. 10 shows an electrode outer surface having the exemplary surface irregularities shown in FIG. 9.

The inner surface irregularities on the tube can be of a wide variety of sizes and shapes. In a preferred embodiment, the inner surface irregularities are cross-groove microfins, as best shown in FIGS. 8–9. Other types of internal surface regularities that are suitable for the present invention, include, but are not limited to microfin tubes, porous surfaces, sintered surfaces, and abraided surfaces (such as sand blasted surfaces). It should be understood that almost any type of surface irregularity will be useful with the present invention. With a microfin surface, the fins are typically very small. For example, a typical microfin is approximately 12/1000 of an inch high for a 5/8 inch diameter tube.

It is desirable to maximize the roughness of the inner surface of the tube. As the surface becomes more rough, the electric field becomes more intense. The electric field becomes particularly intense at the sharp points of the surface roughness. An additional benefit of increasing the roughness of the surface is that less voltage is required. Theoretically, the ideal shape for the irregularities would be infinitely thin needles that extend radially from the inner surface of the tube immediately adjacent the outer surface of the electrodes. This shape will draw the maximum electric field around the irregular surface, thereby maximizing the heat transfer rate. Much less power is needed in order to obtain the desired heat transfer characteristics with such a shape. However, it may not be feasible to have such a design because of practical constraints such as tube manufacturing limitations. It is believed that the optimum design will be a compromise, achieved by balancing the various factors such as electric field, pressure drop, fluid flow, and shape and size of the surface irregularities, to achieve a optimum design for a given heat exchanger.

While it is desirable to maximize the roughness of the inner surface, it is also desirable to minimize the size of the gap between the electrode and the inner surface of the tube. The optimum size of the gap takes into consideration both the size of the surface irregularities and the resulting pressure drop from the gap. It is desirable to have the gap be only slightly larger than the surface roughness. However, if the gap is too small, the pressure drop will become too large. Therefore, it is important to balance these considerations for each specific application.

In a particular embodiment, the evaporator has a length of 16 feet, however other lengths can be used. A tube having an inner diameter of 5/8" will be suitable for an electrode having a 3/8" outer diameter in the particular embodiment. The sizing of the components can be greatly varied depending upon the specific application requirements.

The heat exchangers according to the present invention have an improved heat transfer coefficient. Because of the large increase in heat transfer coefficient which occurs with the present invention, the size of the heat exchangers for a particular application can be significantly decreased. Therefore, the present invention is especially suitable for HVAC systems where size constraints are important.

The operation of the apparatus will be described below. In the preferred embodiment, the heat exchanger is an evaporator, however, the present invention can also be used in a condenser with minor modifications which will be described later. For the sake of the discussion below, the operation will be described with regard to an evaporator, and in particular, to a shell and tube direct expansion evaporator.

A first fluid comprising a refrigerant flows into a refrigerant inlet 60 as shown in FIG. 2. The refrigerant is directed from the refrigerant inlet 60 into inlet refrigerant baffle region 64, then into each of the tubes 20. The refrigerant flows inside the tubes in the space 28 between the outer surface of the electrode 26 and the inner surface 24 of the tube 20. A predetermined voltage is applied to each of the electrodes 26, thereby creating an electric field on the inner surface 24 of each of the tubes 20. The electric field forces the refrigerant to press against the inner surface irregularities of the inner surface, thereby increasing the heat rate to a second fluid.

The refrigerant exchanges heat with a second fluid comprising a heat transfer fluid flowing across the outside of the tubes. The heat transfer fluid is typically water, with additives such as propylene glycol (PG) or ethylene glycol (EG) in order to prevent the water from freezing. The heat transfer fluid enters the shell casing at the heat transfer fluid inlet 14, flows across the outside of the plurality of tubes 20, and exits through the heat transfer fluid outlet 16. As the heat transfer fluid flows across the tubes, the temperature of the heat transfer fluid decreases due to heat transfer to the refrigerant through the tubes 20. The refrigerant is at a lower temperature than the heat transfer fluid, therefore, heat is transferred from the heat transfer fluid to the refrigerant, thereby cooling the heat transfer fluid while heating and ultimately evaporating some or all of the refrigerant.

After the refrigerant has flowed through the entire length of the tubes, the refrigerant exits the tubes 20 and flows into the refrigerant exit region 36. The refrigerant then leaves the heat exchanger via the refrigerant exit port 42.

The size and design of the evaporator varies greatly depending on the specific application. Some evaporators can reach up to about 16 feet long with a 3 foot diameter, however, other lengths and widths can be used to accommodate different flow rates and levels of heat exchange. Some evaporators will be very large with a large number of tubes, others will be very small with only a few bundles.

As is evident from the above description, the present invention includes a method for effectuating an exchange of heat between a heat transfer fluid and a refrigerant in a shell and tube heat exchanger. The steps include providing an electrode inside a hollow tube; flowing the refrigerant through the hollow tube in a space between the electrode and hollow tube, the refrigerant flowing along an inner surface of the hollow tube having surface irregularities; flowing the heat transfer fluid around an outer surface of the hollow tube; and applying a voltage to the electrode to create an electric field, the electric field pressing the refrigerant against the surface irregularities of the hollow tube to increase the heat transfer rate between the refrigerant and the heat transfer fluid.

Although the above description is directed toward the use of the present invention in an evaporator, the principles of the invention are also suitable for a condenser. In a condenser, the surface irregularities will be provided on the outer surface of the electrode and the smooth surface will be provided on the inner surface of the tube. The rough surfaces on the electrode will promote a higher electric field along the outer surface of the electrode. The liquid refrigerant will be pulled toward the high electric field on the electrode. Because the liquid refrigerant is being pulled away from the heat transfer surface, the refrigerant vapor will travel along the inner surface of the tubes. The outside of the electrode in the condenser can have a variety of different surface irregularities. Suitable surface irregularities include, but are not limited to, cross-groove microfins, porous coatings, sintered surface, abrasion, and threads.

It will be apparent to those skilled in the art that various modifications and variations can be made in the apparatus and method for increasing the heat transfer rate of a heat exchanger, use of the apparatus of the present invention, and in construction of this apparatus, without departing from the scope or spirit of the invention.

Other embodiments of the invention will be apparent to those skilled in the art from consideration of the specification and practice of the invention disclosed herein. For example, the present invention is not limited to single pass heat exchangers, but can be used with multiple pass heat exchangers. The present invention is suitable in any application where it is desirable to improve the heat transfer characteristics between two fluids. It is intended that the specification and examples be considered as exemplary only, with a true scope and spirit of the invention being indicated by the following claims.

What is claimed is:

1. An evaporator for transferring heat between a heat transfer fluid and a refrigerant, comprising:

a tube including a first end, a second end, an inner surface with surface irregularities, and an outer surface, the surface irregularities having sharp points; and an electrode located inside and spaced from the tube, the electrode including a smooth outer surface and having a voltage applied to produce an electric field, the refrigerant flowing through the tube in the space between the outer surface of the electrode and the inner surface of the tube, and the heat transfer fluid flowing over the outer surface of the tube, wherein the outer surface of the electrode and the inner surface of the tube are spaced apart from each other such that the electric field produced by the applied voltage of the electrode is intensified around the sharp points of the surface irregularities and presses the refrigerant against the surface irregularities on the inner surface of the tube in order to increase the heat transfer rate between the refrigerant and the heat transfer fluid.

2. The evaporator of claim 1, wherein the electrode comprises a longitudinal rod that is capable of conducting electricity.

3. The evaporator of claim 2, wherein the evaporator comprises a plurality of the tubes and the electrodes.

4. The evaporator of claim 3, wherein each electrode extends beyond the first end of the corresponding tube.

5. The evaporator of claim 4, further comprising an electrode plate for connecting the plurality of electrodes to a source of electricity, the electrode plate being connected to the portion of each electrode that extends beyond the first end of the tube.

6. The evaporator of claim 5, wherein the electrode plate comprises a thin plate with a plurality of holes, each of the plurality of holes engaging a corresponding electrode, the electrode plate being connected to a source of electricity.

7. The evaporator of claim 1, wherein the electrode is spaced from the inner surface of the tube by an electrode insulator for electrically insulating the tube from the electrode.

8. The evaporator of claim 1, wherein the inner surface irregularities of the tube comprise cross groove microfins.

9. A heat exchanger assembly for use in an HVAC system, comprising:

a shell-type casing;

a plurality of tubes located inside the shell-type casing, each of the tubes having an outer surface and an irregular inner surface having sharp points; and a plurality of electrodes, each electrode having a smooth outer surface and being located inside one of the corresponding tubes to create a space between the outer surface of the electrode and the inner surface of the tube, wherein a first fluid is located in each space between the outer surfaces of the electrodes and the inner surfaces of the tubes, and a second fluid is located in a space between the tubes and the shell-type casing to flow across the outer surfaces of the tubes, the outer surfaces of the electrodes and the inner surfaces of the tubes being spaced apart from each other such that an electric field produced by a voltage being applied on the electrodes is intensified around the sharp points of the irregular inner surfaces to press the first fluid against the irregular inner surfaces in order to increase the rate of heat transfer between the first fluid and the second fluid.

10. The heat exchanger assembly of claim 9, further comprising an electrode plate for imparting the voltage on the electrodes, the electrodes being electrically connected to each other.

11. The heat exchanger assembly of claim 10, further comprising a tube head, refrigerant baffle, and cover plate, the tube head comprising a plate with holes for maintaining a first end of the tubes, the electrodes extending beyond the first end of the tubes and the tube head, wherein the tube head, refrigerant baffle and cover plate define a first region for the first fluid prior to the first fluid exiting from the heat exchanger assembly.

12. The heat exchanger assembly of claim 11, wherein the first fluid is a refrigerant, and the temperature of the refrigerant increases as the refrigerant flows from a second end of each tube to the first end of each tube.

13. A heat exchanger assembly for use in an HVAC system, comprising:

a shell-type casing;

a plurality of tubes located inside the shell-type casing, each of the tubes having an outer surface, an inner irregular surface and a first end;

a tube head comprising a plate with holes for maintaining the first ends of the tubes;

a plurality of electrodes, each electrode being located inside one of the corresponding tubes to create a space between the electrode and the inner surface of the tube and extending beyond the first end of the tube and the tube head;

a refrigerant baffle and a cover plate, in conjunction with the tube head, defining a first region for a first fluid prior to the first fluid exiting from the heat exchanger assembly;

an electrode plate mounted in the first region for imparting a voltage on the electrodes, the electrodes being electrically connected to each other; and a plurality of spacers for electrically insulating the electrodes from the shell-type casing, the electrode plate being mounted in the first region by the plurality of spacers, wherein the first fluid is located in each space between the electrodes and the inner surfaces of the tubes, and a second fluid is located in a space between the tubes and the shell-type casing to flow across the outer surfaces of the tubes, the voltage being applied on the electrodes in order to increase the rate of heat transfer between the first fluid and the second fluid.

14. A heat exchanger assembly comprising:

a tube including a first end, a second end, an inner surface and an outer surface; and an electrode located inside and spaced from the inner surface of the tube, the electrode including an outer surface, the electrode having a voltage applied to produce an electric field, wherein a first fluid flows in the space between the outer surface of the electrode and the inner surface of the tube, and a second fluid flows along the outer surface of the tube, one of the inner surface of the tube and the outer surface of the electrode including surface irregularities having sharp points, the other of the inner surface of the tube and the outer surface of the electrode being smooth, the outer surface of the electrode and the inner surface of the tube being spaced apart from each other such that the electric field is intensified around the sharp points of the surface irregularities to pull the first fluid toward the surface irregularities to increase in the heat transfer rate between the first fluid and the second fluid.

15. The heat exchanger assembly of claim 14, wherein the inner surface of the tube includes said surface irregularities, and the heat exchanger assembly comprises an evaporator.

16. A method of exchanging heat between a heat transfer fluid and a refrigerant in a shell and tube heat exchanger, comprising the steps of:

providing an electrode having an outer surface inside a hollow tube having an inner surface, one of the inner surface of the hollow tube and the outer surface of the electrode being smooth;

providing surface irregularities having sharp points on the other of the inner surface of the hollow tube and the outer surface of the electrode;

flowing the refrigerant through the hollow tube between the outer surface of the electrode and the inner surface of the hollow tube, the refrigerant flowing along the inner surface of the hollow tube;

flowing the heat transfer fluid around an outer surface of the hollow tube;

applying a voltage to the electrode to create an electric field; and spacing the outer surface of the electrode and the inner surface of the tube from each other such that said electric field is intensified around the sharp points of the surface irregularities to press the refrigerant against the surface irregularities to increase the heat transfer rate between the refrigerant and the heat transfer fluid.

17. The method of claim 16, wherein the step of providing an electrode inside a hollow tube includes providing an electrode for each of a plurality of hollow tubes.

18. The method of claim 17, wherein said step of applying a voltage to each of the electrode includes attaching an electrode plate to a first end of each of the plurality of electrodes to supply the voltage to the plurality of electrodes.

* * * * *